US005119749A

United States Patent [19]

Velleca et al.

[11] Patent Number: 5,119,749

[45] Date of Patent: Jun. 9, 1992

[54] APPARATUS FOR PREVENTING LEAKAGE OF OIL AND THE LIKE FROM A TANK

[76] Inventors: W. Anthony Velleca, 819 N. Harbor Dr., No. 65, Redondo Beach, Calif. 90277; Gregory Kirste, 4451 Hazelbrook Ave., Long Beach, Calif. 90808; Charles Smith, 5700 Baltimore Dr., No. 35, La Mesa, Calif. 92042

[21] Appl. No.: 648,905

[22] Filed: Jan. 31, 1991

[51] Int. Cl.[5] ..... B63B 25/08

[52] U.S. Cl. ..... 114/74 R; 114/74 T

[58] Field of Search ..... 114/72, 74 A, 74 T, 114/74 R, 125, 73, 121

[56] References Cited

U.S. PATENT DOCUMENTS

| | | | |
|---|---|---|---|
| 3,385,251 | 5/1968 | Grocott | 114/74 R |
| 3,707,937 | 1/1973 | Liles | 114/74 R |
| 3,859,944 | 1/1975 | Warner | 114/74 R |
| 3,906,880 | 9/1975 | Hebert | 114/74 R |
| 4,409,919 | 10/1983 | Strain | 114/74 R |
| 4,715,309 | 12/1987 | Liberg | 114/74 R X |
| 4,960,347 | 10/1990 | Strange | 114/74 R X |
| 5,031,558 | 7/1991 | Davis | 114/74 R |

FOREIGN PATENT DOCUMENTS

| | | | |
|---|---|---|---|
| 1229123 | 5/1986 | U.S.S.R. | 114/74 R |

OTHER PUBLICATIONS

Philip Hardison, Disclosure Document "An Oil Spill Curtain" Mar. 1990.

Design Concepts, Plans for Tanker Feb. 1990.

Patrick Strain, "Diatank" Segregated Ballast System Apr. 2, 1990.

"Mitigating Tanker Oil Spills by Automatic Cargo Shifting" C. A. Stokes Jun. 5, 1990.

A Composite Liner for Oil Spill Prevention in The Marine Environment K. R. Watson.

Ocean Clean Inc #21 Apr. 10, 1990.

*Primary Examiner*—Edwin L. Swinehart

*Attorney, Agent, or Firm*—Louis L. Dachs

[57] ABSTRACT

The invention includes an expandable closed-off container mounted within the tank. A pump system is coupled to the container for pumping the oil from the tank to the interior of the container. In one embodiment, the apparatus is mounted to a support structure located in proximity to the bottom of the tank and is expandable upward and outward therefrom with the pump system mounted in proximity to the bottom of the tank. In a second embodiment of the invention, the apparatus is mounted in proximity to the top of the tank and is expandable downward and outward. An individual pump is attached to the container.

13 Claims, 5 Drawing Sheets

FIG. 1
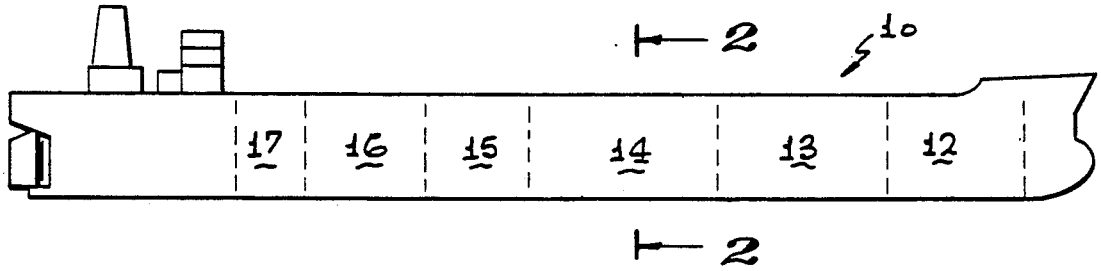
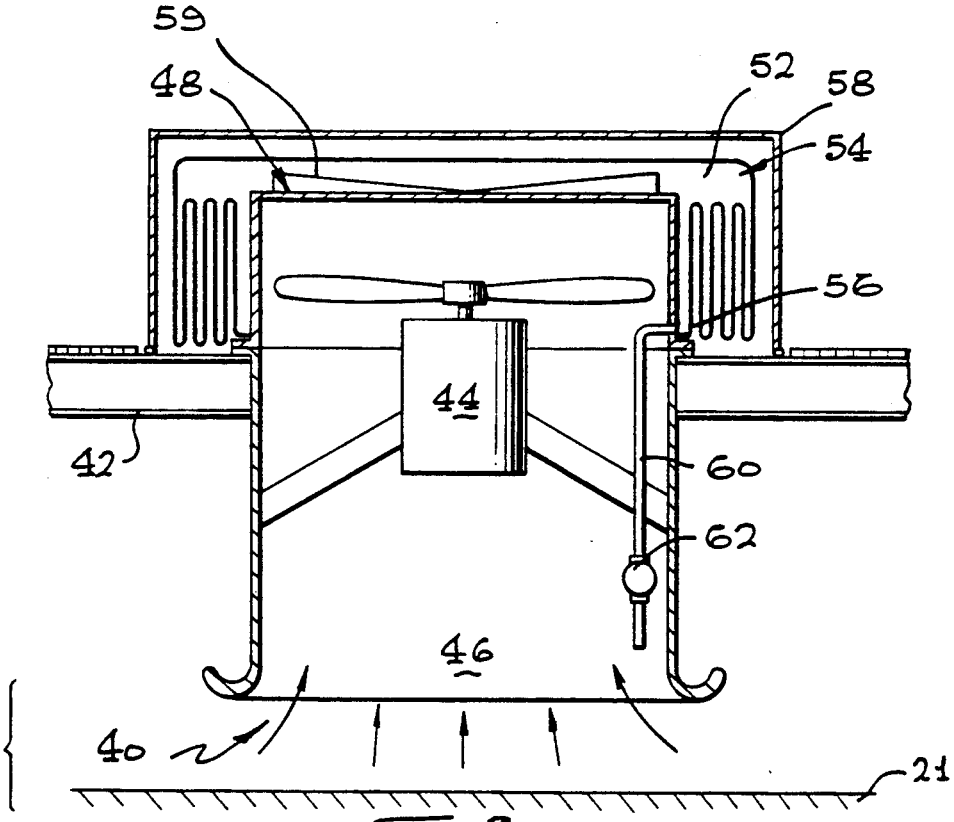
FIG. 3

FIG. 6
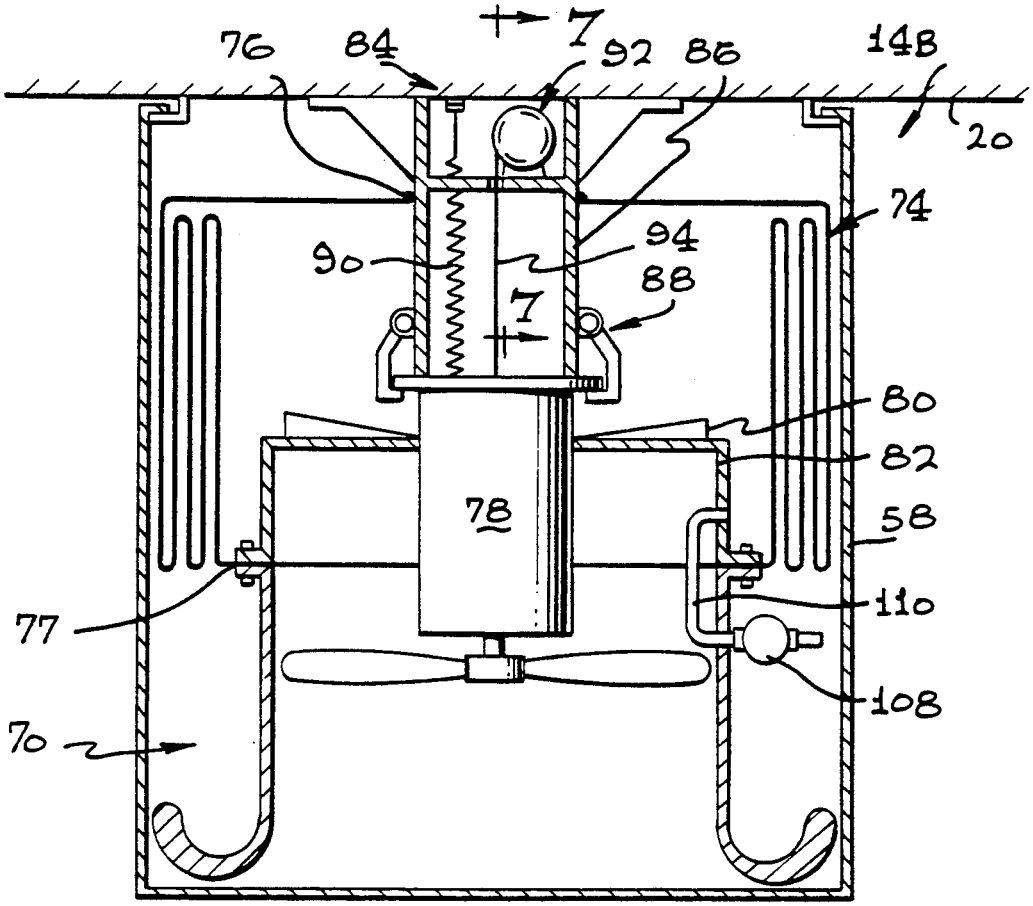
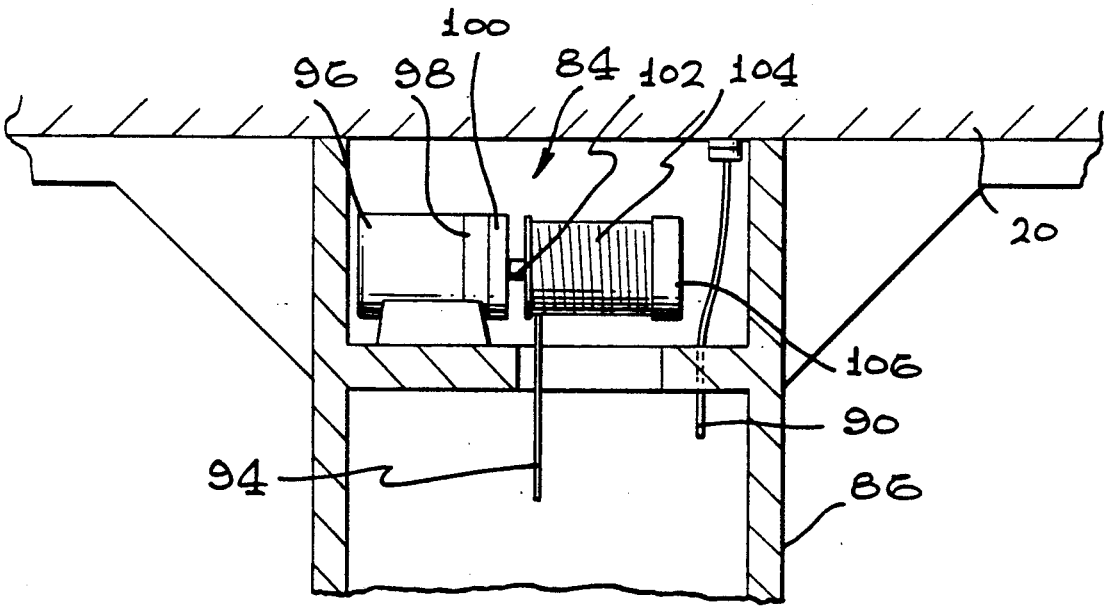
FIG. 7

APPARATUS FOR PREVENTING LEAKAGE OF OIL AND THE LIKE FROM A TANK

BACKGROUND OF THE INVENTION

1. Field of the Invention

The invention relates to the field of leak prevention from a tank having a liquid such as oil therein. It is primarily designed for use in the cargo tanks of ships or any other water borne vessel and, in particular, to a self-contained leak-prevention system for such vessels.

2. Description of Related Art

The disastrous results that can occur when an oil tanker runs aground or collides with another ship are well known, one has to look no further than the Exxon Valdez, which ran aground on Bligh reef in Prince William Sound near Valdez, Ak. spilling 11,000,000 gallons of crude oil. To date, the oil has not been completely removed from the Alaska shoreline. In fact, it is estimated that less then 10 percent of the oil has been recovered. Thus, there has and will continue to be a need for on-board systems to prevent such catastrophes from occurring.

Many solutions have been proposed to reduce the possibility of a major spill from a tanker, with one of the most notable being the recently passed legislation to require all tankers to have double hulls. While the use of dual hulls may reduce the chance of a major oil spill, it will not entirely eliminate such an event from occurring. The momentum of a tanker, when underway, is so enormous that the force produced upon impact with another ship or upon running aground breach both hulls. The use of dual hulls also reduces the cargo carrying volume of the tanker and significantly raises the transportation costs. Additionally, the cost of retrofitting double hulls into existing tankers is extremely expensive, about 15% to 25% of a similar new tanker.

Another approach is to attach a curtain about the periphery of the tanker at a position slightly below deck level. The curtain is stored in a "folded" condition and, when a tank is punctured, the curtain is dropped into the water. The ends of the curtain are weighted causing the curtain to sink to a depth below the keel of the ship. Thus, theoretically, the oil, being lighter than water, would be trapped between the curtain and the hull of the ship. A somewhat similar approach is the use of an inflatable tubular barrier that can be extended about the ship at a short distance therefrom. But these solutions may not always be effective. For example, in high seas or heavy currents, the curtain or inflatable barrier could be ripped apart. If the ship runs aground, the curtain or barrier may not be able to extend sufficiently to be effective.

In general, and particularly in high seas, it is better to prevent the oil from leaking out of the ship rather than to contain the oil locally. Thus, most oil spill prevention systems attempt to prevent or limit the oil from ever leaving the ship in the first place. This is what the previously mentioned double-hull tanker design is attempting to accomplish. An additional idea is to divide the storage tanks into many small compartments by means of bulkheads connected by normally opened valves. Thus, should the hull be punctured, the valves controlling flow to the breached compartments can be closed, limiting the spill to a "relatively" small amount of oil. However, such a system will significantly increase the weight and cost of the tanker. It is also doubtful that such a system could be easily retrofitted to the existing tanker fleet.

Another approach is to "pull" a vacuum from within the tanks to essentially equalize the pressure of the oil and surrounding water. This concept has a major disadvantage because, unless the tanks have a perfect seal, the vacuum pumps must operate continuously during routine tanker operations. In addition, equalizing pressures only eliminates the initial force causing the oil to be expelled from the tank. There are always secondary leak mechanisms, such as currents and high seas. Additionally, there is the phenomenon created by the different surface properties of oil and water, which cause the oil to leak out of the tank at high rates. Tankers, as well as barges, have lost their entire cargo, proving that this phenomenon plays a significant role in causing oil to leak out of a tank. Using the same theory, the oil above the water line could be transferred to other tanks, thus, also equalizing the forces between the oil within the tank and the surrounding water. However, there are three major disadvantages with this concept. First, if plumbing is designed to allow oil to be transferred to the ballast tanks, then the likelihood of oil spills caused by the inadvertent transfer of oil to the cargo tanks is increased. Secondly, the tanks are loaded quite carefully in order to avoid inducing extreme loads on the ship during transit. The loads caused by relocating the oil on an already damaged ship could cause even more damage. Thirdly, very high-pressure and high-flow-rate pumps will have to be retrofitted for the concept to be effective. Another approach is to fill the tanks only to the waterline; however, this procedure will severely impact the cost of transporting the oil. For example, it has been estimated by the National Transportation Board that, if the Exxon Valdez used this approach, it would carry some three million dollars less oil per voyage.

To avoid the loss of oil carrying tank volume, several systems have been developed that allow the use of the cargo tanks for carrying the seawater ballast. One of these is disclosed in U.S. Pat. No. 3,707,937 "Anti-Pollution Ballast Container" by H. Likes. Likes discloses a bellows type tank mounted in the bottom of one or more of the fuel tanks. Seawater can be pumped into the bellows causing it to expand upward into the tank. Thus, the ballast can be isolated from the oil contaminated tank and can be latter dumped without fear of contaminating the surrounding area. A similar "collapsible tank within a tank" system has been developed by Diatank Ltd. Ontario, Canada. In this system, the collapsible tank comprises a moveable top lid attached to the side of the tank by a flexible fabric sheet. Seawater can be pumped from the exterior of the ship into the collapsible lower tank. Thus, the seawater is separated from the "empty" contaminated portion of the oil tank. In another version, the flexible fabric is attached to the top of the oil tank, thus, when carrying oil, the flexible fabric serves as a liner for the side and a portion of the bottom of the oil tank.

An additional approach is to line the interior of the tank with a high-strength, flexible fabric made from materials such as DuPont Corporation's KEVLAR brand aramid fibers. In reality, the interior of the tank is far from smooth and free from internally mounted structures such as ladders, pipes, tank-washing systems, heating coils and pumps. It is doubtful that the liner could be continuous and would have many joined sections and openings that would have to be sealed to internal tank structure. Therefore, a rigorous inspection program would be required to insure that the liner is intact. In addition, the liner would interfere with routine procedures, such as tank maintenance and inspection. The liner would have to be removed in order to allow inspection of major tank integral structure. The liner could also become impregnated with volatile compounds and flammable gases can become trapped behind the liner.

A system of interest can be found in U.S. Pat. No. 3,906,880 "Oil Recovery Apparatus For A Tanker" by L. Hebert. Hebert discloses an apparatus for preventing significant amounts of oil from draining from a breached tank. In detail, the apparatus comprises a flexible container attached to the top of the four walls of the tank and covering the top thereof. A flexible wire mesh net shield is positioned underneath the container and attached to the side walls of the tank. Upon a breach of the tank, the wire mesh net can be dropped down so that it lines the interior surface of the outer wall of the tank to protect the container from possible damage that could be caused by the jagged edges of the hole. Pumps are used to transfer the oil from below the container to above it as the container lowers down into the tank, lining the walls and bottom of it.

While the above system might work, it has several disadvantages. First, the container, when in the stored position, covers the entire top surface of the tank, making it difficult to access to the interior of the tank. Additionally, as previously mentioned, the interior of the typical tank contains a significant amount of structure, including ladders, pipes and pumps. Thus, the lowering of the mesh net and container will be difficult to accomplish.

It is therefore a primary object of the subject invention to provide an apparatus that can prevent or greatly reduce the spillage of oil from the cargo tank of a ship when the tank is breached.

It is another primary object of the subject invention to provide an apparatus that can be easily incorporated into existing ships and can prevent or greatly reduce the spillage of oil from the cargo tank of a ship when the tank is breached.

It is another object of the subject invention to provide an apparatus that can be easily incorporated into existing ships without creating the need for significantly altering procedures and that can prevent or greatly reduce the spillage of oil from the cargo tank of a ship when the tank is breached.

It is still another object of the subject invention to provide an apparatus that can prevent or greatly reduce the spillage of oil from the cargo tank of a ship when the tank is breached that can be stored in a minimal space within the tank.

It is a further object of the subject invention to provide an apparatus that can prevent or greatly reduce the spillage of oil from the cargo tank of a ship when the tank is breached that does not require continuous power after being fully activated.

It is a still further object of the subject invention to provide an apparatus that can prevent or greatly reduce the spillage of oil from the cargo tank of a ship when the tank is breached that reduces the risk of transporting oil cargo and reduces the cost compared to the incorporation of double hulls in ships.

SUMMARY OF THE INVENTION

The invention is an apparatus for preventing or minimizing the leakage of a liquid, such as oil, from a cargo tank, primarily the cargo tank of a liquid-carrying ship, barge, or any other type of water-borne vessel or the like. The size and number of the apparatus' needed will depend upon the size, shape, and the amount of internal structure within the individual tank. For example, if the tank is relatively small and incorporates little or no interfering internal structure such as pipes or ladders, then a single apparatus may be sufficient. However, if the tank is large and has a complex internal shape, several of the apparatus of different size and shape may be necessary.

In detail, the apparatus comprises of an expandable closed-off container. The container is stored in a collapsed "folded" shape and is expandable to a shape to fit the particular tank or portion of it. In one embodiment, a support structure is mounted in proximity to the bottom of the tank. The container is attached to the support structure and is expandable upward and outward therefrom. A pump system is mounted in proximity to the bottom of the tank and is coupled to the container and is adapted to pump the oil from the tank to the interior of the container. The apparatus also incorporates a check valve for preventing oil, once within the container, from escaping from it. If a multiple number of apparatus are required, a single pump with a single check valve coupled to all the containers can be used in some circumstances.

Should the tank wall be breached, the pump system is automatically started and the oil is pumped into the container causing it to expand upward and outward. When all or substantially all the oil is pumped into the container, the pump is turned off and the check valve prevents the oil from escaping from the container back into the tank. It is important to note that the pump must operate at high flow rates, in order to minimize the loss of oil; although, it requires little pressure head. Thus, a minimum amount of power is required and such high-flow-rate pumps could pump the oil from a conventional-size tank in a short time. For example, a typical center cargo tank contains about 30,000 barrels or 1,260,000 gallons of oil and two apparatus with 100,000 gallon per minute pumps would pump all the oil in the two containers in about six and one half minutes. Finally, the apparatus incorporates a means to drain the oil from the container.

In a second embodiment of the invention, the apparatus includes a container mounted in proximity to the top of the tank with an individual (or multi-number of pumps) attached thereto. The pump is releasably secured to the top of the tank and, as in the previous embodiment, incorporates a check valve that prevents the oil, once pumped into the container, from flowing back out. The pump can be secured to the top of the tank by any number of means, for example, electromechanical latches. Furthermore, the pump is coupled to a winch system for raising the apparatus into position or lowering it for inspection or maintenance. A speed brake is incorporated to insure that the apparatus descends slowly if inadvertently released, thus allowing maintenance personnel working within the tank, when empty, to move to safety.

When the tank is breached, the pump is released and drops or is lowered to the surface and into the oil and the pump is started, pumping the oil into the container.

As the pump descends to the bottom of the tank, the container expands downward and outward. Of course, the check valve prevents the oil from flowing back out. When all or substantially all the oil has been pumped into the container, the pump is turned off. Finally, this apparatus also incorporates means to drain the oil from the container.

The novel features that are believed to be characteristic of the invention, both as to its organization and method of operation, together with further objects and advantages thereof, will be better understood from the following description in connection with the accompanying drawings in which the presently preferred embodiments of the invention are illustrated by way of examples. It is to be expressly understood, however, that the drawings are for purposes of illustration and description only and are not intended as a definition of the limits of the invention.

BRIEF DESCRIPTION OF THE DRAWINGS

FIG. 1 is a side elevation view of a typical oil tanker.

FIG. 3 is an enlarged partial view of the first embodiment of the apparatus shown in FIG. 2 particularly illustrating the first embodiment of the apparatus in detail.

FIG. 6 is an enlarged cross-sectional view of a portion of FIG. 2 illustrating the second embodiment of the apparatus in detail.

FIG. 7 is an enlarged partial view of a portion of FIG. 6, taken along the line 7—7.

DESCRIPTION OF THE PREFERRED EMBODIMENT

Figure 2:
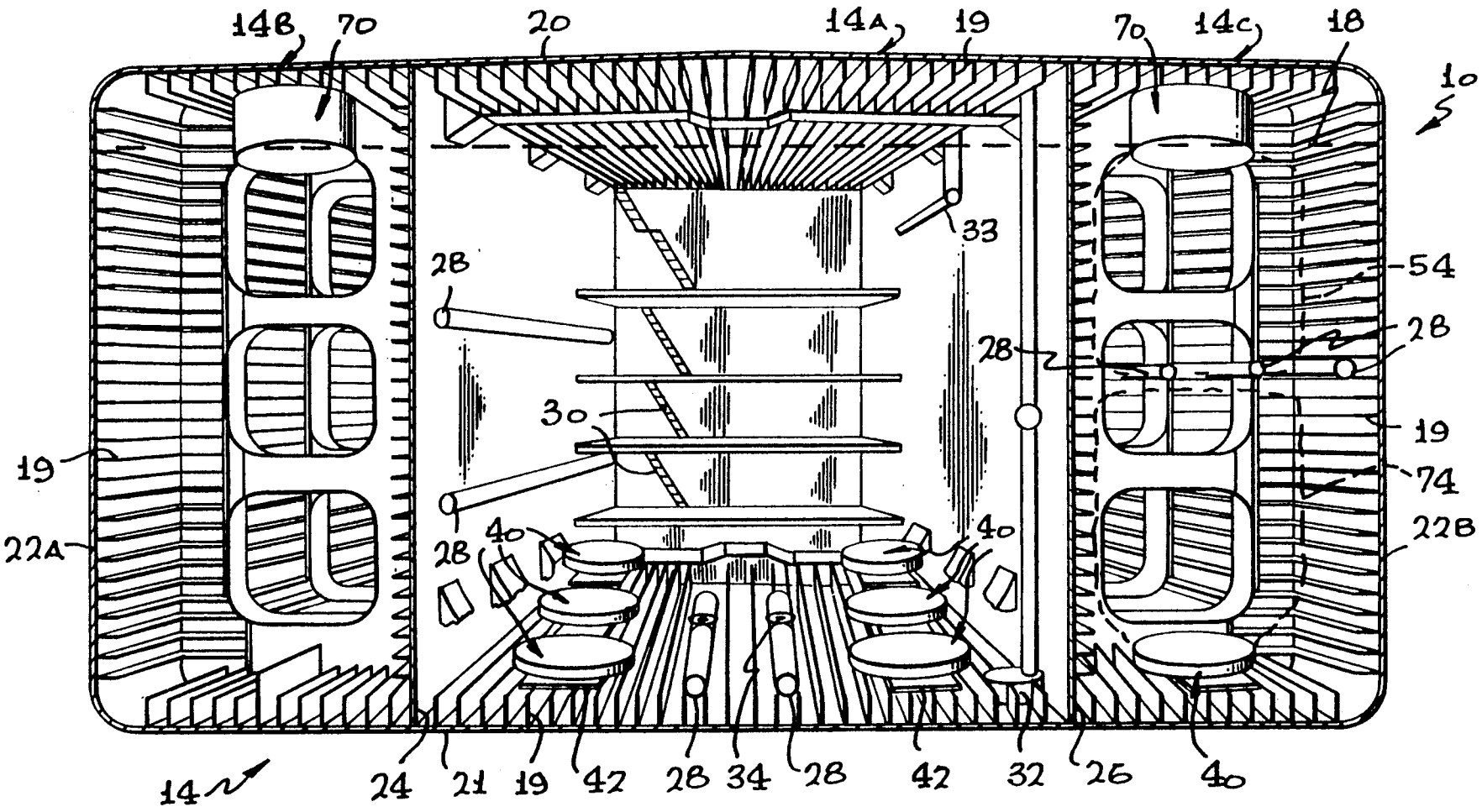
FIG. 2 is a perspective cross-sectional view of the oil tanker shown in FIG. 1 taken along the line 2—2, particularly illustrating the interior of the typical oil cargo tanks, with first and second embodiments of the apparatus installed therein.

Referring to FIGS. 1 and 2, it can be seen that a typical oil tanker is illustrated and generally indicated by numeral 10. The tanker 10 includes a multitude of individual tank sections 12, 13, 14, 15, 16 and 17, and as shown, are filled with oil to a level indicated by numeral 18 (best seen in FIG. 2). The typical tank section, for example, tank section 14, includes a main tank 14A and side tanks 14B and 14C. As shown in FIG. 2, the tanks have a complicated internal reinforcing structure 19 on the top and bottom walls 20 and 21, respectively, outer hull walls 22A and 22B, and longitudinal and transverse bulkheads 24 and 26, respectively. The tanks are further complicated by numerous pipes 28 that pass through the tanks, ladders 30, sump-pump system 32, tank washer 33, valves 34, and heaters 35. Thus, the typical tank is far from "empty" and the arrangement of these internal components vary from tanker to tanker. Thus, it can be seen that just lining the tank bottom and outer hull walls with a fabric liner would be difficult to accomplish. Many individual segments with numerous joints would be required in order to follow closely the contour of the tank walls. There is also doubt that, if the structure were in fact closely followed, the liner could easily fail upon impact. Additionally, it should now be clearly seen that the previously mentioned U.S. Pat. No. 3,906,880 "Oil Recovery Apparatus For A Tanker" by L. Hebert would be extremely difficult to install and made to function in any practical manner. However, the subject invention can easily accommodate such a complicated tank structure.

A first embodiment of the invention is illustrated in FIGS. 2, 3, 4, and 5. As depicted, several apparatuses are shown in the stored condition, generally indicated by numeral 40, attached to a support structure 42 mounted near the bottom wall 21 of the main tank 14A. A pump 44 is attached to the structure 42 having an inlet 46 and an outlet 48 coupled to the interior 52 of a closed-off container 54. The container 54 includes an open end 56 attached to the pump 44 that is normally stored in a folded fashion thereabout. The container 54 is made of a flexible, high strength material such as DuPont Corporation's KEVLAR brand aramid fiber cloth. Preferably, a removable protective cover is positioned over the container 54 and pump 44 and releasably attached thereto. For example, the cover could be a simple flexible cover 58 having an elasticized edge for retention purposes. A check valve 59 is mounted on the outlet 48 of the pump 44 to prevent oil, once pumped into the container 54, from flowing back out. Finally, a pipe 60 is coupled via a valve 62 to the outlet 48 of the pump 44 to allow oil to be drained from the container 54.

Figure 4:
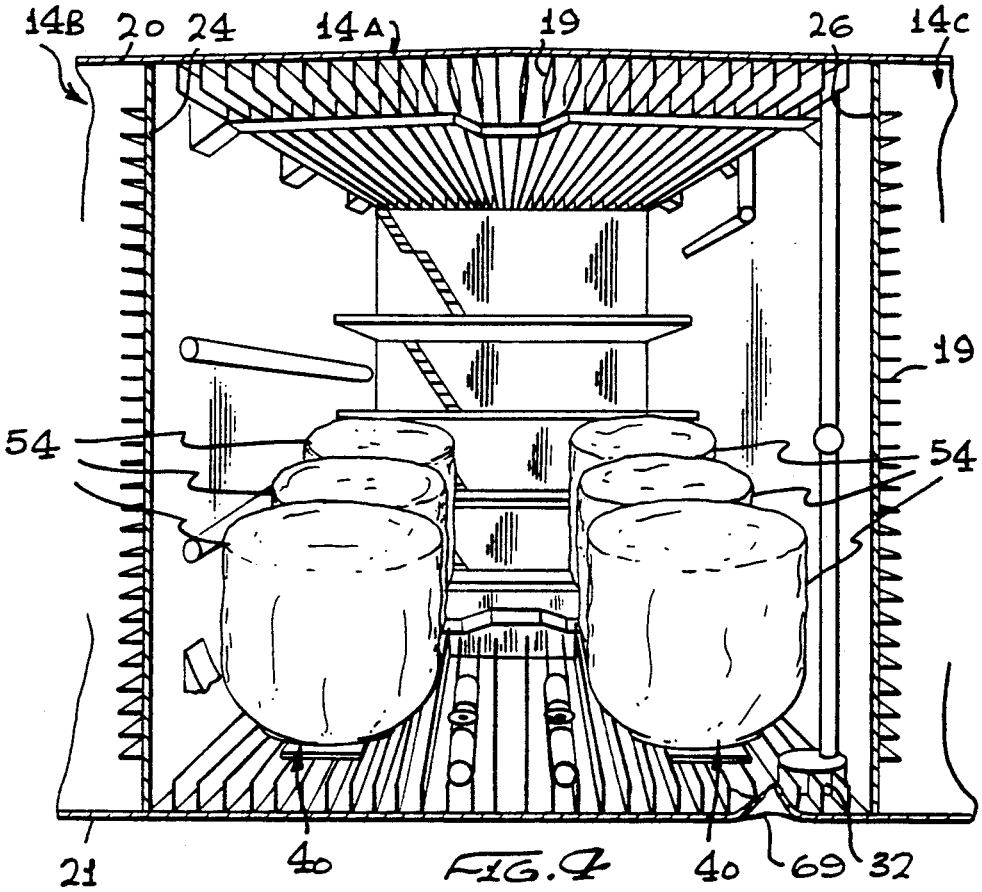
FIG. 4 is a partial simplified view of FIG. 2 illustrating the first embodiment of the apparatus in a partially deployed position.
Figure 5:
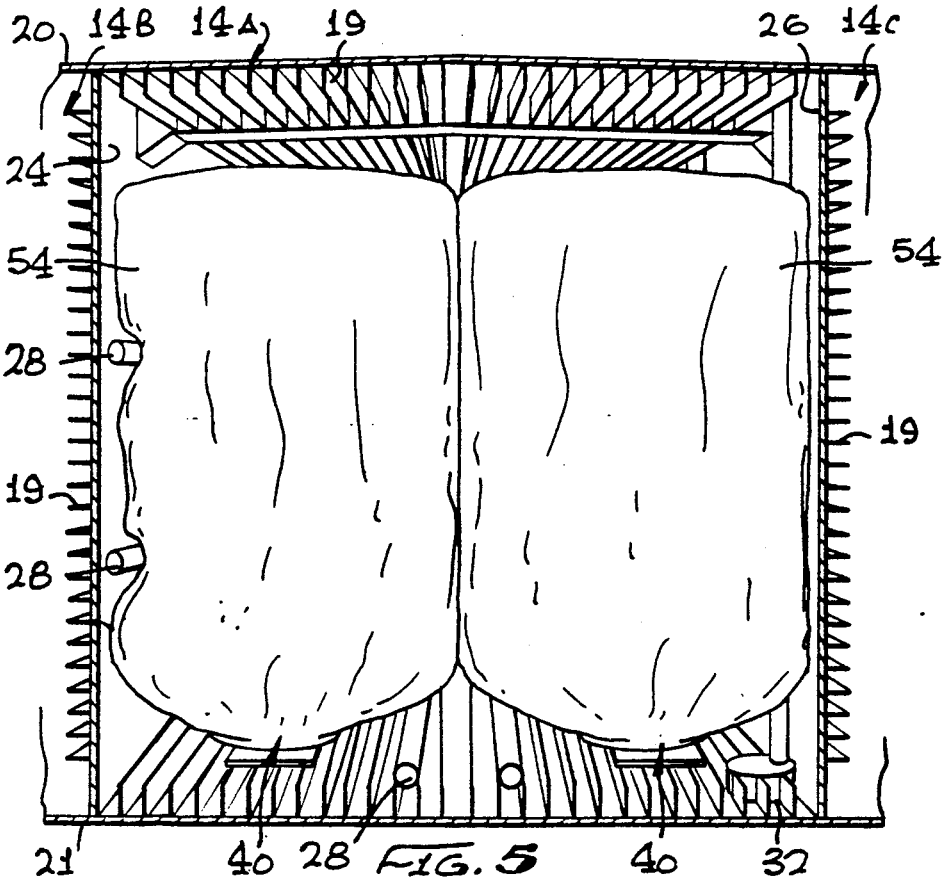
FIG. 5 is a simplified view of a portion of FIG. 2 illustrating the first embodiment of the apparatus in a fully deployed position.
Figure 8:
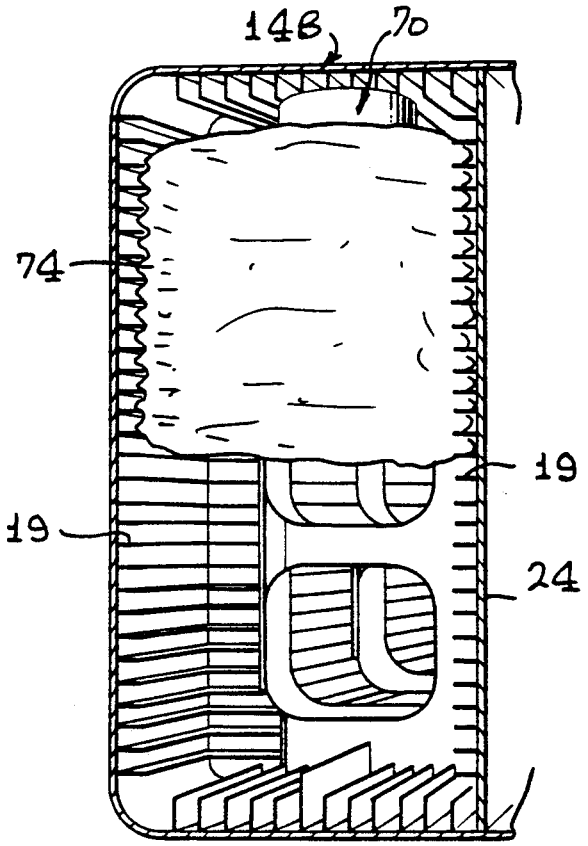
FIG. 8 is a partial simplified view of a portion of FIG. 2 illustrating the second embodiment of the apparatus in the partially deployed position.

For purposes of illustration, suppose the tanker 10 has run aground and the tank 14A has been breached at a point 69 in the bottom wall 21, as illustrated in FIG. 4. Upon occurrence of such an event, the pump 44 is activated causing oil to be pumped into the container 54. Automatic actuation may be accomplished by using quadredundant tank pressure sensors and/or oil level sensors coupled to a computer control system, none of which are shown. This will in turn cause the container 54 to expand upward and outward, ejecting the cover 58, as illustrated in FIG. 4. Continued pumping will fill the container 54, as illustrated in FIG. 5. With all the apparatuses 40 within the tank 14A actuated, most of the oil will be contained within the container and the pumps can be manually turned off. This can also be accomplished automatically. Regardless, only a residue of oil and water will remain in the tank. As can be seen, the containers can be sized to fit into the major spaces of the tank 14 with relative ease. After the tanker has reached port, the oil can be drained from the container by opening bypass valve 62 and pumping the oil out of the container via pipe 60.

A second embodiment of the invention is disclosed in FIGS. 2, 6, 7, 8 and 9. In this embodiment, a plurality of apparatus 70 are attached to the top wall 20 of the tank 14B. Referring particularly to FIG. 7, each apparatus 70 includes a closed off expandable container 74 attached at one end 76 to the top of the tank and at the other end 77 to a pump 78 and is stored in a folded manner similar to the container 54 shown in FIG. 3. The pump 78 is preferably a counter-rotating design or is constrained by a anti-torque system (not shown) which will eliminate the tendency to rotate due to a "torque action" that could cause the container to twist. A check valve 80 is mounted on the outlet 82 of the pump 78. The pump 78 is maintained in the position shown in FIGS. 2 and 6 by means of a retaining system, indicated by numeral 84. The system 84 includes a hollow tubular member 86 attached at one end to the top wall 20 and releasably coupled at the bottom end to the pump 78 by means of electromechanical clamps 88. Note that the end 76 is shown attached to the hollow tubular member 86. A coiled electrical power line 90 connected to the pump 78 is stored therein. A combination winch and speed-brake mechanism 92 is mounted within the member 86 and is attached to the top wall 20 and coupled to the pump 78 by means of a line 94 to insure that the pump 78 will descend at a controlled rate. Referring particularly to FIGS. 6 and 7, the retaining system 84 includes an electric motor 96 with an integral gear reduction assembly 98 and electromechanical locking-type clutch 100. The output shaft 102 of the clutch 100 is connected to drum 104 having the line 94 wound thereabout. Coupled directly to the drum 104 is a speed brake 106 which limits the descent speed of the pump 78. This will provide protection for individuals working within the tank when empty, to avoid being crushed by an apparatus, if it is inadvertently released. Finally, referring to FIG. 6, a bypass valve 108 is incorporated to allow oil to be drained from the tank via a pipe 110.

Figure 9:
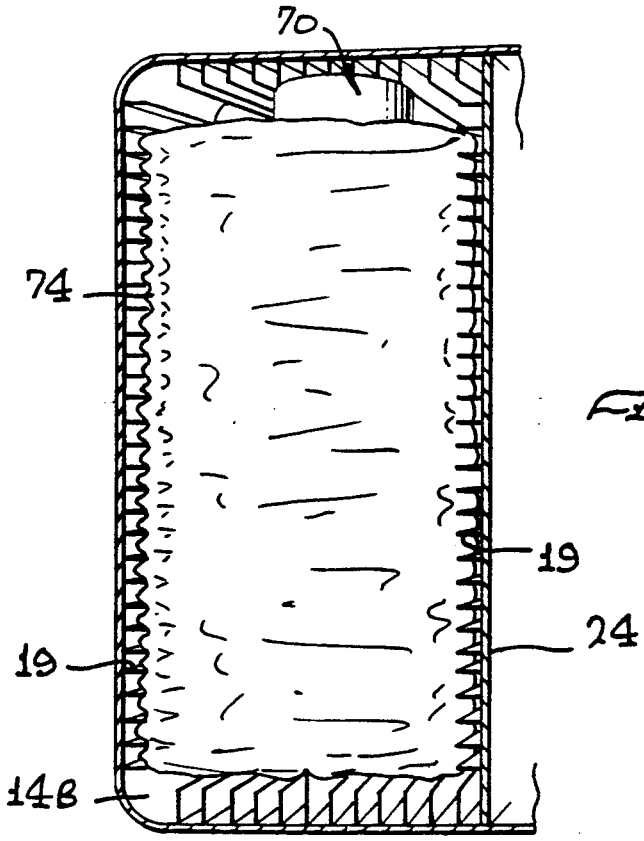
FIG. 9 is a partial simplified view of a portion of FIG. 2 illustrating the second embodiment of the apparatus in the fully deployed position.

In operation, should the tank 14B be breached the apparatuses 70 are actuated. The electromechanical clamps 88 are actuated to release the pump 78 and the clutch 100 is disengaged allowing the pump 78 to "suck" itself into the oil at a controlled rate. The oil will be pumped into the interior of the container 74 causing it to expand downward and outward (best seen in FIG. 8). As in the previous embodiment, the check valve 80 prevents oil, once in the container 74, from flowing back out. When the apparatus has reached the bottom of the tank 14A, substantially all the oil within the tank will have been pumped within the containers, as shown in FIG. 9, and the pumps can then be turned off. Again, upon reaching a port the oil can be pumped out via bypass valve 108 and pipe 110. The apparatuses 70 can be thereafter raised by actuating the clutch 100 and motor 96.

Of course, the two embodiments could be used together within the same tank, if the internal structure so dictated. This can be seen in referring back to FIG. 2 wherein tank 14B incorporates a plurality of pipes 28 that essentially divide the tank in half prevent using only an apparatus 40 or 70, for only about half the oil in the tank could be contained. However, an apparatus 40 at the bottom wall 21 thereof and an apparatus 70 at the top 20 solves the problem, for the containers 54 and 74 could be simultaneously expanded upward and downward, respectively to the pipes 28 (shown in dotted lines).

In conclusion, it can be seen that the apparatus can prevent, or at least greatly reduce, the loss of oil from a breached tank of a ship. Furthermore, even if the tanker "breaks up", the containers may remain intact and, if intact, will float on the surface of the water making recovery quite easy. While the apparatus has been described and illustrated in the drawings as installed on an oil tanker, it must be understood that the apparatus is not limited to use in oil tankers and could be used on barges or any other water-borne vessel. Furthermore, the apparatus can be used to prevent the leakage of any sort of liquid from such vessels. It can be easily incorporated into almost any vessel, will cause little change to existing routine shipboard operations, occupies a small amount of space, and once the containers have been filled, it does not require the continuous application of power to maintain the oil therein. Potentially, it will be significantly cheaper than a double hull vessel. Finally, while primarily directed at water borne vessels, it can be easily incorporated into stationary tanks even those that are land base.

While the invention has been described with reference to particular embodiments, it should be understood that the embodiments are merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to the ship-building and ship-operating industry as well as any land based industry requiring relatively large storage tanks.

We claim:

1. An apparatus for preventing the leakage of a liquid from a cargo tank, the tank having a top, bottom and sides, the apparatus comprising:

an expandable closed-off container mounted within the tank, said container storable in a collapsed condition and expandable to a volume filling at least a portion of the tank; and a pump means mounted in the tank and coupled to said container, said pump means having an inlet coupled to the interior of the tank and an outlet coupled to the interior of said container, said pump means for pumping the liquid from the tank to the interior of said container.

2. The apparatus as set forth in claim 1 further comprising:

a support structure mounted within said tank and in proximity to the bottom thereof;

said container attached to said support structure and expandable outward from said structure; and said pump means mounted in proximity to the bottom of the tank.

3. The apparatus as set forth in claim 1 further comprising:

said container mounted to the top of the tank and expandable outward from the top of the tank;

said pump means releasably mounted at the top of the tank and attached to said container and movable in a downward direction upon release from the top of the tank, as said container expands outward direction; and means to release and attach said pump means to the top of the tank.

4. The apparatus as set forth in claim 3 including means to control the rate of movement of said pump means downward upon release thereof from the top of the tank, as said container expands downward and outward from the top of the tank.

5. The apparatus as set forth in claim 4, including means to raise said pump means to the top of the tank.

6. The apparatus as set forth in claim 2 or 5 wherein said pump means includes one-way check valve means for preventing liquid once within said container from escaping therefrom.

7. The apparatus as set forth in claim 6 wherein said pump means comprises a pump coupled to said container.

8. The apparatus as set forth in claim 7 further including means to drain the liquid from said interior of said container.

9. An improvement to a water-borne vessel having at least one liquid carrying cargo tank, said tank having a top, bottom and sides, the improvement comprising:

at least one expandable closed-off container mounted within the tank of the vessel, said container storable in a collapsed condition and expandable to a volume filling at least a portion of the tank; and a pump means mounted within the tank and attached to each of said at least one container, said pump means having an inlet coupled to the interior of the tank and an outlet coupled to the interior of said at least one container, said pump means for pumping the liquid from the interior of the tank of the interior of said at least one container.

10. The improvement as set forth in claim 9 further comprising:

a support structure mounted within said tank in proximity to the bottom thereof;

said at least one container attached to said support structure and expandable outward from said structure; and said pump means mounted in proximity to the bottom of the tank.

11. The improvement as set forth in claim 9 further comprising:

said at least one container is mounted at the top of the tank and expandable outward from the top of the tank;

said pump means releasably mounted at the top of the tank and attached to said at least one container and movable in a downward direction upon release from the top of the tank as said container expands in an outward direction; and means to release and attach said pump means to the top of the tank.

12. The apparatus as set forth in claim 9 or 10 or 11 wherein said at least one container is storable in a collapsed condition and expandable to a volume filling at least a portion of the tank.

13. The apparatus as set forth in claim 12 wherein said pump means includes one-way check valve means for preventing liquid once within said at least one closed-off expandable container from escaping therefrom.

* * * * *